US008590278B2

(12) United States Patent
Boldis et al.

(10) Patent No.: US 8,590,278 B2
(45) Date of Patent: Nov. 26, 2013

(54) METHOD FOR THE FLUID-TIGHT SEALING OF FILLED MEDICAMENT CAPSULES

(75) Inventors: Josef Boldis, Biberach an der Riss (DE); Sabine Landerer, Rissegg (DE); Thorsten Neuhaus, Biberach an der Riss (DE)

(73) Assignee: Boehringer Ingelheim International GmbH, Ingelheim am Rhein (DE)

( * ) Notice: Subject to any disclaimer, the term of this patent is extended or adjusted under 35 U.S.C. 154(b) by 0 days.

(21) Appl. No.: 13/530,618

(22) Filed: Jun. 22, 2012

(65) Prior Publication Data

US 2013/0081358 A1 Apr. 4, 2013

Related U.S. Application Data

(63) Continuation of application No. 12/667,887, filed as application No. PCT/EP2008/058869 on Jul. 8, 2008, now abandoned.

(30) Foreign Application Priority Data

Jul. 10, 2007 (EP) ..... EP07112137
Aug. 3, 2007 (EP) ..... EP07113801

(51) Int. Cl.
*A61J 3/07* (2006.01)
*B65B 31/04* (2006.01)

(52) U.S. Cl.
USPC ..... 53/432; 53/454; 53/471; 53/900

(58) Field of Classification Search
USPC ..... 53/432, 433, 454, 471, 478, 485, 510, 53/511, 560, 281, 375.9, 900; 156/69
See application file for complete search history.

(56) References Cited

U.S. PATENT DOCUMENTS

| | | | |
|---|---|---|---|
| 2,314,527 | A | 3/1943 | Taylor |
| 2,831,301 | A | 4/1958 | Martell |
| 4,196,564 | A | 4/1980 | Bodenmann et al. |
| 4,403,461 | A | 9/1983 | Goutard et al. |
| 4,522,666 | A | 6/1985 | Wittwer |
| 4,543,138 | A | 9/1985 | Bollinger et al. |

(Continued)

FOREIGN PATENT DOCUMENTS

| | | | |
|---|---|---|---|
| DE | 3718320 | A1 | 12/1987 |
| EP | 0180543 | A2 | 5/1986 |
| EP | 1414639 | A1 | 5/2004 |

OTHER PUBLICATIONS

International Search Report for PCT/EP2008/058869 mailed Dec. 4, 2008, 6 pages.

*Primary Examiner* — Stephen F Gerrity
(74) *Attorney, Agent, or Firm* — Michael P. Morris; Philip I. Datlow

(57) ABSTRACT

The present invention relates to a method, a device, and a control program for the fluid-tight sealing of capsules containing medicaments, wherein the capsules consist of at least one capsule body and a capsule cap which are set one into the other telescopically and provided with a tight band in the abutment region on the exterior side of the capsule, wherein the capsule components are filled with gas which has a changed temperature and/or a changed pressure in relation to the environment, and wherein a reduction of the difference in pressure in the capsule occurs via gaps between capsule body and capsule cap after the capsule components have been placed one inside the other. The capsules produced via the method according to the invention are disposable capsules and preferably contain a single dose of an orally administered pharmaceutical formulation in the form of a powder or a liquid.

20 Claims, 5 Drawing Sheets

(56) References Cited

U.S. PATENT DOCUMENTS

| | | | |
|---|---|---|---|
| 4,581,875 | A | 4/1986 | MacLaughlin et al. |
| 4,667,455 | A | 5/1987 | Morrow |
| 4,724,019 | A | 2/1988 | Brown et al. |
| 4,756,902 | A | 7/1988 | Harvey et al. |
| 4,893,721 | A | 1/1990 | Bodenmann et al. |
| 4,922,682 | A | 5/1990 | Tait et al. |
| RE33,251 | E | 7/1990 | Wittwer et al. |
| 4,991,377 | A | 2/1991 | Marchesini |
| 5,632,971 | A | 5/1997 | Yang |
| 5,930,984 | A | 8/1999 | Furuya et al. |
| 6,949,154 | B2 | 9/2005 | Hochrainer et al. |
| 2005/0211364 | A1 | 9/2005 | Hochrainer et al. |

METHOD FOR THE FLUID-TIGHT SEALING OF FILLED MEDICAMENT CAPSULES

This application is a continuation of U.S. patent application Ser. No. 12/667,887, filed Apr. 15, 2010, now abandoned, which is the national stage entry under 35 USC 371 of international application number PCT/EP2008/058869, filed Jul. 8, 2008.

The present invention relates to a method, an apparatus and a control programme for the fluidtight sealing of capsules containing medicaments in which the capsules consist of at least a capsule body and a capsule cap which are fitted telescopically one inside the other and are provided with a sealing band in the junction region on the outside of the cap.

The capsules produced by the method according to the invention are single-use capsules and preferably contain a single dose of a medicament for oral administration in the form of a powder, paste or liquid.

Capsules containing pharmaceutical preparations are widely used in the treatment and diagnosis of diseases. The capsules may be administered orally or are used in medical devices. As a rule, the capsules comprise two parts, a capsule body (body) and a capsule cap (cap) which are fitted telescopically one inside the other. However, multi-part capsules are also known. The capsules usually consist of gelatin, particularly hard gelatin. For some special applications, the capsules are occasionally also made of water-soluble plastics that are well tolerated in humans, so as to release the active substance in particular sections of the gastro-intestinal tract after oral administration. The following are examples of different capsule materials.

EP 0460921 describes capsules made of chitosan and starch, cereal powder, oligosaccharides, methacrylic acid-methyl acrylate, methacrylic acid-ethyl acrylate, hydroxypropylmethyl-cellulose acetate, succinate or phthalate. The capsule material is characterised in that the contents are not released until it reaches the large bowel.

GB 938828 discloses capsules for radioactive substances for therapeutic or diagnostic use. The capsules consist of water-soluble gelatin, methylcellulose, polyvinyl alcohol or water-soluble non-toxic thermoplasts.

EP0312760 describes a method of sealing hard gelatin or starch capsules with a particular sealing agent. The seam on the capsules may be offset from the central plane of the longitudinal axis of the capsule.

DE 3430764 discloses another method of sealing hard gelatin capsules. In this method, the capsules are first of all filled and the two capsule halves are fitted telescopically one inside the other. Then a contact zone is exposed on the capsule body by lifting the capsule cap away from the capsule body, but without opening the capsule. In a next step, the contact zone is then made "tacky" and the capsule cap is then pushed back into its original position and thus brought into contact with the contact zone. This process has to be performed with high precision particularly as it is essential to avoid deforming the capsule when the capsule cap is replaced on the capsule body that has been made tacky by heating and is thus susceptible to deformation. On page 32 of the application it mentions that holding and guiding the capsule parts requires tools that have no tolerances or play whatsoever.

The capsules that are to be filled are filled as homogeneously as possible with the medicament, which is generally provided in liquid form, in capsule filling machines with a pre-set dosing volume. The metered amount flows into the lower part of the capsule, the capsule body. After filling, the capsule body is closed off by the replacing of the capsule cap.

As the capsule filling machines operate at high cycle rates, the fitting of the capsule cap takes a few milliseconds. A problematic aspect of this is that the gas present in the unfilled volume of the capsule body and particularly in the unfilled volume of the capsule cap is compressed by the fitting together of the parts. This internal pressure may cause the capsule parts to be pushed apart again.

To prevent this, encircling annular depressions may be provided in the capsule body and in the capsule cap, which engage in one another when the cap is fitted onto the body, as described EP 1414639 B1. In addition, elevated and depressed spots are also described, which engage in one another after the parts have been fitted together and thus ensure a better grip.

If capsules are to be provided with a liquid active substance, the capsules must be protected from leaking. For this reason the capsules have to be sealed. The sealing may be carried out for example by welding the capsule parts together, as shown in EP1414639 B1.

In addition, sealing may be carried out by introducing a sealing adhesive into or onto the gap formed by the capsule body and capsule cap, or a band may be applied to the outside of the capsule in the region of the junction between the capsule parts. The band generally consists of the same material as the capsule parts and is applied to the capsule exterior by rolling or spraying on.

If the gas inside the capsule is under pressure, this may cause defects to occur in the applied band during or after the application of the banding liquid, as a result of gas escaping from the inside of the capsules at the junction with the cap. This induced gas flow leads to the formation of channels from the inside of the capsule to the outside, and is observed for example through the formation of bubbles in the applied band at the junction of the banded capsule.

If no channels are formed, the excess pressure present may cause the capsule to become elongated on one side at the point of application of the band as a result of local overwetting, meaning that there is a reduction in the stability of the capsule wall at the site of the band application. The elongation of the capsule which is generally one-sided, i.e. uneven around its circumference, at the site of the application of the band, eventually results in capsules bent into a banana shape. Capsules thus bent cannot be packaged and are discarded as rejects.

CN1440740 describes a method of filling capsules consisting of a cap and a body that is filled with a liquid preparation, the filling and the application of a sealing adhesive being carried out under reduced pressure.

U.S. Pat. No. 4,403,461 describes a method of sealing hard gelatin capsules consisting of a capsule body and a capsule cap that are glued together. In order to produce capsules of this kind, U.S. Pat. No. 4,403,461 envisages first dipping a pin coated with a membrane into a metering chamber for an adhesive. This chamber has the dimensions of an upper capsule part and has a channel filled with adhesive running round its interior wall. To receive the adhesive, the membrane pulled over the pin is inflated by means of channels in the pin. The adhesive is then applied to the membrane from the channel. In a second step the pin with the membrane is dipped into a capsule cap and the membrane is inflated to the inner circumference of the capsule cap. The annular adhesive bead located on the membrane meanwhile is applied to the inner surface of the capsule cap. In further steps, the capsule body is for example filled with a liquid active substance. The filled capsule body and the capsule cap provided with adhesive are transported into an evacuatable chamber and joined together under reduced pressure.

A disadvantage of the methods and apparatus described particularly in CN1440740 and U.S. Pat. No. 4,403,461 is that with the capsule parts being fitted one inside the other the pressure state prevailing during the insertion must remain steady, as the adhesive applied causes a leaktight seal to be produced immediately. If, for example, the medicament is introduced at elevated temperature, as is necessary for example in the case of waxy pastes in order to measure the dose, the gas present in the capsule heats up and a pressure builds up which acts on the sealing adhesive. To prevent this, alternatively the process times would have to be selected so that first of all cooling can take place before the capsule is sealed, requiring undesirably long process times. A further disadvantage is that the application of the adhesive for producing a leaktight seal according to the teaching of these specifications takes place before the parts are fitted together. Thus adhesive may get into the inside of the capsule and it is necessary to integrate the step of the adhesive application into the capsule filling, thereby slowing down the cycle times of the filling machine.

One aim of the invention is therefore to provide a method for the fluidtight sealing of capsules containing medicaments, preferably liquid medicaments, which allows hermetic sealing of the capsules with a process that is simpler in design compared with the prior art.

A further aim is to provide a sealing method that prevents leaks from capsules filled with medicaments, preferably liquid medicaments.

Another aim is to provide an apparatus for carrying out the method which makes it possible to apply a band to capsules, preferably fluid-filled capsules, while avoiding leaks.

A further aim is to provide a sealing method in which the medicament in the capsule is not contaminated with adhesives as a result of the fluidtight sealing process and hence the pharmaceutical quality of the medicament remains unaffected.

The present invention solves the problem described hereinbefore by providing a new sealing method in which the capsules, having been filled with the medicament and joined together, are provided with a sealing band in the junction region on the outside of the capsule. The characterising feature of this is that before being fitted together the capsule parts are filled with a gas which is at a different temperature and/or a different pressure relative to the environment and also after the capsule parts have been fitted one inside the other a reduction in differential pressure in the capsule takes place through gaps between the capsule body and capsule cap.

Advantageously, compared with the prior art, it is thus possible for equalisation of the air with the environment to take place even after sealing. As a result, significantly lower requirements are imposed on the provision of a vacuum in the apparatus, since even after the capsule parts have been fitted inside one another any excess pressure still present in the assembled capsule can be released. If a heated gas is enclosed as atmosphere in the capsules, the pressure of which then decreases as the result of the cooling of the gas, it is also conceivable that ambient gas will flow into the capsules from outside. Moreover, the method according to the invention and the associated apparatus allow the sealing process to be modular. The filling and assembling of the capsules in the capsule filling machine may be carried out under reduced pressure or using a process gas at elevated temperature. In a second step the band is then applied.

This has the advantage that compared with the prior art only minor design modifications are needed to the known sealing apparatus currently in use.

The capsules that are to be sealed by this method may consist of synthetic polymers, natural and synthetic starch or a-1.4;a-1,6-glucan (pullulan), and preferably gelatin or hydroxypropyl methyl cellulose (HPMC), which do not themselves substantially affect the pharmaceutical quality of the contents but improve the usability of the filled capsule in terms of its function, shelf life and/or climatic zone and are advantageous at different stages from manufacture to use.

According to the present invention the term medicaments encompasses active substances of medicaments, mixtures of different medicaments and medicament compositions, as well as medicament formulations or combinations and mixtures of the above-mentioned substances.

The capsule consists of at least two parts, a capsule body (body) and at least one capsule cap (cap), which may be joined together so as to form a stable closed-off cavity of defined volume which contains the pharmaceutical formulation.

Preferably the material of the capsule has a permeation coefficient for water vapour of less than $10^{-13}$ kg/(m s Pa), preferably less than $1.3\times10^{-14}$ kg/(m s Pa). Preferably the coefficient is between $10^{-15}$ and $5\times10^{-16}$ kg/(m s Pa), particularly preferably between $5\times10^{-16}$ and $2\times10^{-16}$ kg/(m s Pa). The advantage of this property is that it prevents the water concentration and hence the medicament concentration in the capsule from changing.

The cap and body of the capsule are of mutually congruent, cylindrical form, consisting of an inherently closed wall with a closed and an open side in each case. The shape and size of the cap and body are such that the body can be pushed telescopically with its open end into the open end of the cap.

In a preferred embodiment bulges or dimples are formed in the capsule body or capsule cap. When the capsule parts provided with these elevations and indentations are fitted into one another, ideally defined uniform gaps of from 10 microns to 500 microns, more particularly 20 microns to 50 microns, are formed along the contact surface between the capsule body and the capsule cap placed thereon. The gaps are designed so as to ensure on the one hand that equalisation of gas and pressure are made possible by the inflow or outflow of gas between the environment and the capsule interior and on the other hand none of the liquid filling can escape.

In special embodiments the cap and body are provided with closure means that are advantageous for the temporary and/or final closure of the capsule. In such an embodiment, elevated points may be provided on the inner wall of the cap and somewhat larger indented points are provided on the outer wall of the body, which are arranged so that when the capsule is closed the elevations fit into the indentations. Alternatively the elevations may be formed on the outer wall of the body and the indentations on the inner wall of the cap. Arrangements in which the elevations or indentations are arranged in a ring or spiral around the wall are preferred. Instead of the point-like configuration of the elevations and indentations, these may encircle the wall of the cap or body in an annular configuration, although advantageously recesses and openings are provided which enable an exchange of gases into and out of the capsule interior.

In one embodiment, one or more elevations are provided in an annular arrangement around the inner wall of the cap and the outer wall of the body such that, in the closed state of the capsule, an elevation on the cap is located adjacent to an elevation on the body.

In another embodiment elevations are formed on the outside of the body close to the open end and indentations are formed in the cap close to the open end such that the elevations on the body latch into the indentations in the cap in the closed state of the capsule. The elevations may be such that the cap can be opened at any time without damage to the capsule or, alternatively, so that once it has been closed the capsule cannot be opened again without destroying it.

Capsules with one or more such latching mechanisms (latches) (for example two encircling grooves) are preferred.

Particularly preferred are capsules with at least two such latching means which secure the two capsule parts to different degrees. In a part of this kind, a first latching means may be formed close to the openings in the capsule cap and the capsule body and a second can be shifted somewhat further towards the closed end of the capsule parts. The first latching means secures the two capsule parts less strongly than the second.

This variant has the advantage that after the production of the empty capsules the capsule cap and capsule body can initially be temporarily joined together using the first latching mechanism. In order to fill the capsule the two capsule parts are then separated again. After filling, the two capsule parts are pushed together until the is second set of latches firmly secures the capsule parts.

In another embodiment, a bead is formed on the outside of the body, extending in a circle around the body perpendicularly to the connecting axis between the cap and body. The bead acts as a stop for the cap when the latter is pushed over the body, to prevent the body pushing right through the cap. The region between the open end of the body and the bead corresponds to the region of the body over which the cap can be pushed. The bead is located on the body such that the cap can be pushed far enough over the body to achieve a firm closure between the cap and body. In other words, the bead is not located directly on the open side of the body, for example. The side of the bead that points towards the open end of the body stands as a perpendicular edge on the outer wall of the body such that the cap cannot be pushed past the bead during closure. The side of the bead pointing towards the closed end of the body may be in the form of a substantially right-angled edge or may flatten out towards the closed end of the body. The formation of a substantially right-angled edge may be advantageous when the capsule is being loosely fitted into a capsule holder, while the variant with the flattened bead is suitable for firm fitting. The bead has interruptions for the exchange of gases.

The thickness of the walls of the cap and body may vary over the entire range. Thus, the wall thickness is generally greater in the rounded areas of the cap or body or at the point on the body where the bead is formed than in the areas in which the walls are straight. In one embodiment, the walls of the cap and body have a thickness of 0.1 mm to 0.5 mm, and preferably the capsule has an average wall thickness of 0.1 mm to 0.4 mm, more preferably 0.2 mm to 0.4 mm. The capsule body has a thickness of 0.15 mm to 0.35 mm, preferably 0.225 mm to 0.275 mm, most preferably 0.25 mm, in the region of its opening, particularly at its edge.

The capsule cap has a thickness of 0.25 mm to 0.45 mm, preferably 0.325 mm to 0.375 mm, most preferably 0.35 mm, in the region of its opening, particularly at its edge.

The length of the capsule is 8 mm to 30 mm, preferably 13 to 17 mm, most preferably 15.5 mm to 16 mm. The diameter of the capsule is 4 mm to 7 mm, preferably 5.3 mm to 6.3 mm. Most preferably 5.75 to 5.95 mm. A preferred capsule has a length of 15.9 mm, a diameter of the capsule body of 5.57 mm and a diameter of the capsule cap of 5.83 mm. The preferred wall thickness of the capsule body is 0.25 mm and that of the capsule cap is 0.35 mm.

For producing a fluidtight seal between at least two parts of the capsule that can be inserted telescopically one inside the other the lower capsule parts that are to be filled are held in the capsule filling machines in capsule carriers, particularly dies. These are cylindrical shaped parts made of stainless steel which are held and moved inter alia by radial guide rods or a chain. The lower capsule part, the capsule body, sits in a through-bore. A collar or a tapering in the diameter of the bore prevents the lower capsule part from slipping downwards. There are various known methods and machines for filling capsules. These resemble one another in that they operate primarily by volumetric principles, less often by gravimetric principles. A given metering volume is filled as homogeneously as possible with the medicament, which is in liquid form, for example. Usually, the capsule body is filled almost completely with the active substance. After filling, the capsule body is closed by the cap being put on.

The known capsule filling machines operate at high throughput rates, so that up to 100000 capsules per hour are filled with the medicament.

The measures used for quality control comprise a random sampling of the capsules to check that they contain the correct amount of filling. The quality of the capsules is judged on the basis of the random samples and corresponding statistical calculation. Usually, the random sampling is carried out by weighing.

If there is excess pressure in the capsule, this may cause the capsule cap that has been put on to become detached and move out of position. In order to detect this movement the length of the capsules is determined. If the measured length of the capsules along the longitudinal axis through the capsule differs from a given desired length by more than 0.1 mm to 1 mm, more particularly 0.2 mm to 0.4 mm, the capsule is rejected.

In order to prevent the liquid from escaping from the capsule, in the case of capsules filled with liquid medicaments, the capsule is sealed in the region of the junction of the two capsule parts.

Different sealing techniques may be used for this. During the sealing of the capsules with a band, the assembled capsules filled with the active substance are moved individually in compartments on a conveyor belt. The capsules are transported lying down at a band speed of 0.1 metre per second to 2 metres per second, preferably 0.4 metre per second to 0.8 metre per second and rotate about their own longitudinal axis at a low speed of rotation. This rotation is cased by the movement of the open compartments in the conveyor belt relative to the base underneath the compartments. Inclining the compartment relative to the direction of travel ensures that as they rotate the capsules will also undergo a force component at right angles to the direction of travel, so that the capsules are uniformly pressed against an end face of the compartments. This ensures that the junction region of the assembled capsules is located at a specified position. At these positions, the compartments are provided with a recess so that banding discs that pass through a bath containing banding liquid and in doing so absorb liquid on their circumferential end face are then able to apply this liquid to the junction region. Application is carried out by means of two banding discs arranged one behind the other. In the first process step a first banding disc applies the sealing solution to the circumference of the capsule. The liquid wets the side of the capsule and may also penetrate slightly into the gap as a result of the capillary effect. Advantageously, a gelatin solution with a viscosity of 150 cP to 250 cP, particularly 180 cP to 210 cP is used for banding hard gelatin capsules. The solution is advantageously applied at a temperature of 40 degrees Celsius to 70 degrees Celsius, advantageously 50 degrees Celsius to 60 degrees Celsius. In order to eliminate and compensate any possible defects in this first application such as bubbles, areas where the solution is missing and uneven areas, a second banding disc carries out a further application of the banding solution. Another possible method of sealing comprises introducing a sealing solution preferably into the gap between the capsule parts. For this, a sealing solution is sprayed into the joint between the assembled capsule parts. The viscosity of the liquid is selected so that it flows into the joint as a result of capillary forces and fills it completely to form a ring. Excess liquid is removed by suction.

To monitor the seal of the capsules they are arranged in a single layer on nonwoven cloths in storage boxes and after drying or setting of the sealing strip they are exposed to conditions of reduced pressure in a vacuum cupboard in order to trigger leakage from any defects that may be present in the strip applied. Capsules with leaks are revealed, when stored or tested under conditions of reduced pressure, by the fact that the cloth is damp. The capsules around the leak are discarded and the capsules found to be leaktight are packaged.

In the method according to the invention the filling and sealing of the capsules are preferably carried out in modular fashion i.e. the filling is carried out in a capsule filling apparatus and the application of the band or the spray sealing are carried out in a capsule sealing apparatus.

For the filling process, empty capsules are supplied to a capsule filling machine, while the upper part of the capsule, namely the cap, is fitted on loosely. The capsules are received and held by capsule carriers. Then the cap is removed from the body and the capsule body is filled with the medicament. Then the capsule cap is placed on the filled body. As a result of the high process speed, the placement of the cap is complete within a few milliseconds. At the same time the unfilled volume of residual gas present in the body and the volume of the gas in the cap are reduced to the unfilled inner volume of the capsule.

To prevent unacceptable excess pressure from forming in the interior of the capsule, it is proposed according to the invention that the fitting on of the cap be carried out at a different pressure, more particularly at a pressure that is lower than ambient, or that the capsule parts be filled with a gas at elevated temperature which loses pressure on cooling. Advantageously, a gap should additionally remain between the cap to allow further equalisation of the pressure difference after the cap has been fitted on.

Preferably, reduced pressure is created in the capsule filling machine. To do this, the filling chamber or interior of the capsule filling machine may be provided with a seal against the environment. This may be for example adhesive strips or plastic seals made of silicon, for example.

In order to be able to create a defined reduced pressure, pressure gauges are preferably provided in the capsule filling machine and in the surrounding area. The pressure data are stored by a control device with a data memory. From the pressure data, a desired reduced pressure is calculated, depending on the capsule material and the medicament to be packaged and the process or machine parameters of the capsule filling machine, and is created using a regulated vacuum pump. The vacuum pumps that may be used are water jet suction, rotary slide pumps, rotary pumps and diaphragm pumps. Alternatively there is preferably also the option of creating reduced pressure locally. For this, the capsule holders, capsule dies are surrounded by a pressuretight pot-shaped housing. Before the capsule parts are assembled, the pot-shaped housings are brought together so as to be positioned close to one another. To achieve this, in terms of design, a housing part may be provided with an edge and a seal abutting on the edge of the counterpart. A defined reduced pressure is then produced using gas-carrying pipes, or a low-pressure process gas is piped in. Preferably, a defined reduced pressure of 50 Pa to 5000 Pa, particularly preferably 100 Pa to 500 Pa relative to the pressure in the environment, is created in the capsule filling machine.

In order to keep the pressure in the interior substantially constant, an airlock chamber is advantageously provided on or in the capsule filling machine. After this airlock chamber has been brought to the same reduced pressure as the interior of the capsule filling machine by pumping, the filled capsules are brought into the chamber, the airlock chamber is then closed off in pressuretight manner from the interior of the machine by means of a seal and then ambient pressure is applied to release the capsules from the airlock.

Alternatively or in addition to the application of reduced pressure when assembling the capsule parts, it is preferably envisaged that the capsule parts be filled with a heated gas before being assembled.

As the gas cools once the capsule parts have been assembled, this cooling leads to a lowering of the pressure in the gas enclosed in the capsule as the capsule cap is put on and thus helps to prevent the formation of bubbles or breaking of the seal. The heated gas is introduced by means of a nozzle the air current of which is directed towards the open capsule parts, particularly towards the capsule cap.

Advantageously, the process gas used is nitrogen which has been heated to a temperature of 50 degrees Celsius to 180 degrees Celsius, particularly preferably 80 degrees Celsius to 120 degrees Celsius.

The nozzle is from 5 cm to 50 cm, particularly preferably from 10 cm to 30 cm wide. After the heated gas has been put in, the capsule filled with a liquid active substance should be cooled to ambient temperature before the capsule is sealed. For this purpose it is envisaged that the capsule holders be provided with cooling means. The cooling means used may be for example water cooling means or a Peltier element integrated in the capsule holder.

For controlling the process steps for filling and sealing the capsules, the apparatus according to the invention has a control device such as a microcontroller or a control computer. For regulating the method according to the invention and the control device, the software takes the process parameters for metering the medicament into the capsule body from a data memory. In addition, the software detects the actual pressure and temperature data of the capsule filling apparatus by means of sensors arranged on the apparatus and from them it calculates the target data for the pressure and temperature of the process gas. Using regulating means such as vacuum pumps or heating elements and cooling elements, the software regulates these target data by means of the control device.

The compounds listed below may be used in the device according to the invention on their own or in combination. In the compounds mentioned below, W is a pharmacologically active substance and is selected (for example) from among the betamimetics, anticholinergics, corticosteroids, PDE4-inhibitors, LTD4-antagonists, EGFR-inhibitors, dopamine agonists, H1-antihistamines, PAF-antagonists and PI3-kinase inhibitors. Moreover, double or triple combinations of W may be combined and used in the device according to the invention. Combinations of W might be, for example:

W denotes a betamimetic, combined with an anticholinergic, corticosteroid, PDE4-inhibitor, EGFR-inhibitor or LTD4-antagonist, W denotes an anticholinergic, combined with a betamimetic, corticosteroid, PDE4-inhibitor, EGFR-inhibitor or LTD4-antagonist, W denotes a corticosteroid, combined with a PDE4-inhibitor, EGFR-inhibitor or LTD4-antagonist W denotes a PDE4-inhibitor, combined with an EGFR-inhibitor or LTD4-antagonist W denotes an EGFR-inhibitor, combined with an LTD4-antagonist.

The compounds used as betamimetics are preferably compounds selected from among albuterol, arformoterol, bambuterol, bitolterol, broxaterol, carbuterol, clenbuterol, fenoterol, formoterol, hexoprenaline, ibuterol, isoetharine, isoprenaline, levosalbutamol, mabuterol, meluadrine, metaproterenol, orciprenaline, pirbuterol, procaterol, reproterol, rimiterol, ritodrine, salmefamol, salmeterol, soterenol, sulphonterol, terbutaline, tiaramide, tolubuterol, zinterol, CHF-1035, HOKU-81, KUL-1248 and 3-(4-{6-[2-hydroxy-2-(4-hydroxy-3-hydroxymethyl-phenyl)-ethylamino]-hexyloxy}-butyl)-benzyl-sulphonamide 5-[2-(5,6-diethyl-indan-2-ylamino)-1-hydroxy-ethyl]-8-hydroxy-1H-quinolin-2-one 4-hydroxy-7-[2-{[2-{[3-(2-phenylethoxy)propyl] sulphonyl}ethyl]-amino}ethyl]-2(3H)-benzothiazolone 1-(2-fluoro-4-hydroxyphenyl)-2-[4-(1-benzimidazolyl)-2-methyl-2-butylamino]ethanol 1-[3-(4-methoxybenzyl-amino)-4-hydroxyphenyl]-2-[4-(1-benzimidazolyl)-2-methyl-2-butylamino]ethanol 1-[2H-5-hydroxy-3-oxo-4H-1,4-benzoxazin-8-yl]-2-[3-(4-N,N-dimethylaminophenyl)-2-methyl-2-propylamino]ethanol 1-[2H-5-hydroxy-3-oxo-4H-1,4-benzoxazin-8-yl]-2-[3-(4-methoxyphenyl)-2-methyl-2-propylamino]ethanol 1-[2H-5-hydroxy-3-oxo-4H-1,4-benzoxazin-8-yl]-2-[3-(4-n-butyloxyphenyl)-2-methyl-2-propylamino]ethanol 1-[2H-5-hydroxy-3-oxo-4H-1,4-benzoxazin-8-yl]-2-{4-[3-(4-methoxyphenyl)-1,2,4-triazol-3-yl]-2-methyl-2-butylamino}ethanol 5-hydroxy-8-(1-hydroxy-2-isopropylaminobutyl)-2H-1,4-benzoxazin-3-(4H)-one 1-(4-amino-3-chloro-5-trifluoromethylphenyl)-2-tert.-butylamino)ethanol 6-hydroxy-8-{1-hydroxy-2-[2-(4-methoxy-phenyl)-1,1-dimethyl-ethylamino]-ethyl}-4H-benzo[1,4]oxazin-3-one 6-hydroxy-8-{1-hydroxy-2-[2-(ethyl 4-phenoxy-acetate)-1,1-dimethyl-ethylamino]-ethyl}-4H-benzo[1,4]oxazin-3-one 6-hydroxy-8-{1-hydroxy-2-[2-(4-phenoxy-acetic acid)-1,1-dimethyl-ethylamino]-ethyl}-4H-benzo[1,4]oxazin-3-one 8-{2-[1,1-dimethyl-2-(2,4,6-trimethylphenyl)-ethylamino]-1-hydroxy-ethyl}-6-hydroxy-4H-benzo[1,4] oxazin-3-one 6-hydroxy-8-{1-hydroxy-2-[2-(4-hydroxy-phenyl)-1,1-dimethyl-ethylamino]-ethyl}-4H-benzo[1,4]oxazin-3-one 6-hydroxy-8-{1-hydroxy-2-[2-(4-isopropyl-phenyl)-1.1 dimethyl-ethylamino]-ethyl}-4H-benzo[1,4]oxazin-3-one 8-{2-[2-(4-ethyl-phenyl)-1,1-dimethyl-ethylamino]-1-hydroxy-ethyl}-6-hydroxy-4H-benzo[1,4]oxazin-3-one 8-{2-[2-(4-ethoxy-phenyl)-1,1-dimethyl-ethylamino]-1-hydroxy-ethyl}-6-hydroxy-4H-benzo[1,4]oxazin-3-one 4-(4-{2-[2-hydroxy-2-(6-hydroxy-3-oxo-3,4-dihydro-2H-benzo[1,4]oxazin-8-yl)-ethylamino]-2-methyl-propyl}-phenoxy)-butyric acid 8-{2-[2-(3.4-difluoro-phenyl)-1,1-dimethyl-ethylamino]-1-hydroxy-ethyl}-6-hydroxy-4H-benzo[1,4]oxazin-3-one 1-(4-ethoxy-carbonylamino-3-cyano-5-fluorophenyl)-2-(tert-butylamino)ethanol 2-hydroxy-5-(1-hydroxy-2-{2-[4-(2-hydroxy-2-phenyl-ethylamino)-phenyl]-ethylamino}-ethyl)-benzaldehyde N-[2-hydroxy-5-(1-hydroxy-2-{2-[4-(2-hydroxy-2-phenyl-ethylamino)-phenyl]-ethylamino}-ethyl)-phenyl]-formamide 8-hydroxy-5-(1-hydroxy-2-{2-[4-(6-methoxy-biphenyl-3-ylamino)-phenyl]-ethylamino}-ethyl)-1H-quinolin-2-one 8-hydroxy-5-[1-hydroxy-2-(6-phenethylamino-hexylamino)-ethyl]-1H-quinolin-2-one 5-[2-(2-{4-[4-(2-amino-2-methyl-propoxy)-phenylamino]-phenyl}-ethylamino)-1-hydroxy-ethyl]-8-hydroxy-1H-quinolin-2-one

[3-(4-{6-[2-hydroxy-2-(4-hydroxy-3-hydroxymethyl-phenyl)-ethylamino]-hexyloxy}-butyl)-5-methyl-phenyl]-urea 4-(2-{6-[2-(2,6-dichloro-benzyloxy)-ethoxy]-hexylamino}-1-hydroxy-ethyl)-2-hydroxymethyl-phenol 3-(4-{6-[2-hydroxy-2-(4-hydroxy-3-hydroxymethyl-phenyl)-ethylamino]-hexyloxy}-butyl)-benzylsulphonamide 3-(3-{7-[2-hydroxy-2-(4-hydroxy-3-hydroxymethyl-phenyl)-ethylamino]-heptyloxy}-propyl)-benzylsulphonamide 4-(2-{6-[4-(3-cyclopentanesulphonyl-phenyl)-butoxy]-hexylamino}-1-hydroxy-ethyl)-2-hydroxymethyl-phenol N-Adamantan-2-yl-2-(3-{2-[2-hydroxy-2-(4-hydroxy-3-hydroxymethyl-phenyl)-ethylamino]-propyl}-phenyl)-acetamide optionally in the form of the racemates, enantiomers, diastereomers thereof and optionally in the form of the pharmacologically acceptable acid addition salts, solvates or hydrates thereof. According to the invention the acid addition salts of the betamimetics are preferably selected from among the hydrochloride, hydrobromide, hydriodide, hydrosulphate, hydrophosphate, hydromethanesulphonate, hydronitrate, hydromaleate, hydroacetate, hydrocitrate, hydrofumarate, hydrotartrate, hydroxalate, hydrosuccinate, hydrobenzoate and hydro-p-toluenesulphonate.

The anticholinergics used are preferably compounds selected from among the tiotropium salts, preferably the bromide salt, oxitropium salts, preferably the bromide salt, flutropium salts, preferably the bromide salt, ipratropium salts, preferably the bromide salt, glycopyrronium salts, preferably the bromide salt, trospium salts, preferably the chloride salt, tolterodine. In the above-mentioned salts the cations are the pharmacologically active constituents. As anions the above-mentioned salts may preferably contain the chloride, bromide, iodide, sulphate, phosphate, methanesulphonate, nitrate, maleate, acetate, citrate, fumarate, tartrate, oxalate, succinate, benzoate or p-toluenesulphonate, while chloride, bromide, iodide, sulphate, methanesulphonate or p-toluenesulphonate are preferred as counter-ions. Of all the salts the chlorides, bromides, iodides and methanesulphonates are particularly preferred.

Other preferred anticholinergics are selected from among the salts of formula AC-1

AC-1

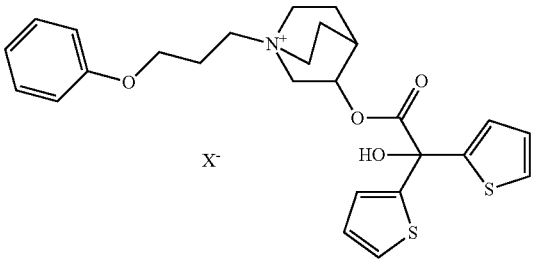

wherein $X^-$ denotes an anion with a single negative charge, preferably an anion selected from among the fluoride, chloride, bromide, iodide, sulphate, phosphate, methanesulphonate, nitrate, maleate, acetate, citrate, fumarate, tartrate, oxalate, succinate, benzoate and p-toluenesulphonate, preferably an anion with a single negative charge, particularly preferably an anion selected from among the fluoride, chloride, bromide, methanesulphonate and p-toluenesulphonate, particularly preferably bromide, optionally in the form of the racemates, enantiomers or hydrates thereof. Of particular importance are those pharmaceutical combinations which contain the enantiomers of formula AC-1-en AC-1-en

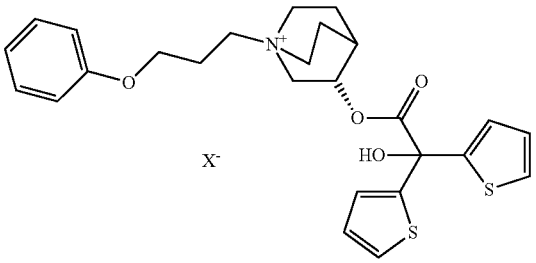

wherein $X^-$ may have the above-mentioned meanings. Other preferred anticholinergics are selected from the salts of formula AC-2

AC-2

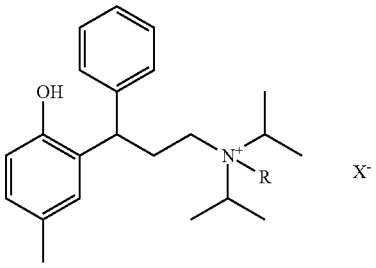

wherein R denotes either methyl or ethyl and wherein $X^-$ may have the above-mentioned meanings. In an alternative embodiment the compound of formula AC-2 to may also be present in the form of the free base AC-2-base.

AC-2-base

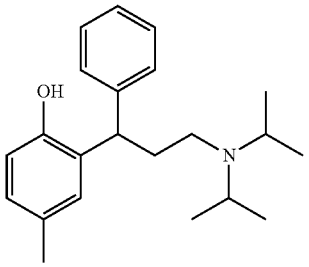

Other specified compounds are:

tropenol 2,2-diphenylpropionate methobromide,
scopine 2,2-diphenylpropionate methobromide,
scopine 2-fluoro-2,2-diphenylacetate methobromide,
tropenol 2-fluoro-2,2-diphenylacetate methobromide;
tropenol 3,3',4,4'-tetrafluorobenzilate methobromide,
scopine 3,3',4,4'-tetrafluorobenzilate methobromide,
tropenol 4,4'-difluorobenzilate methobromide,
scopine 4,4'-difluorobenzilate methobromide,
tropenol 3,3'-difluorobenzilate methobromide,
scopine 3,3'-difluorobenzilate methobromide;
tropenol 9-hydroxy-fluorene-9-carboxylate methobromide;
tropenol 9-fluoro-fluorene-9-carboxylate methobromide;
scopine 9-hydroxy-fluorene-9-carboxylate methobromide;
scopine 9-fluoro-fluorene-9-carboxylate methobromide;
tropenol 9-methyl-fluorene-9-carboxylate methobromide;
scopine 9-methyl-fluorene-9-carboxylate methobromide;
cyclopropyltropine benzilate methobromide;
cyclopropyltropine 2,2-diphenylpropionate methobromide;
cyclopropyltropine 9-hydroxy-xanthene-9-carboxylate methobromide;
cyclopropyltropine 9-methyl-fluorene-9-carboxylate methobromide;
cyclopropyltropine 9-methyl-xanthene-9-carboxylate methobromide;
cyclopropyltropine 9-hydroxy-fluorene-9-carboxylate methobromide;
cyclopropyltropine methyl 4,4'-difluorobenzilate methobromide.
tropenol 9-hydroxy-xanthene-9-carboxylate methobromide;
scopine 9-hydroxy-xanthene-9-carboxylate methobromide;
tropenol 9-methyl-xanthene-9-carboxylate methobromide;
scopine 9-methyl-xanthene-9-carboxylate methobromide;
tropenol 9-ethyl-xanthene-9-carboxylate methobromide;
tropenol 9-difluoromethyl-xanthene-9-carboxylate methobromide;
scopine 9-hydroxymethyl-xanthene-9-carboxylate methobromide, The above-mentioned compounds may also be used as salts within the scope of the present invention, wherein instead of the methobromide the salts metho-X are used, wherein X may have the meanings given hereinbefore for $X^-$.

As corticosteroids it is preferable to use compounds selected from among beclomethasone, betamethasone, budesonide, butixocort, ciclesonide, deflazacort, dexamethasone, etiprednol, flunisolide, fluticasone, loteprednol, mometasone, prednisolone, prednisone, rofleponide, triamcinolone, RPR-106541, NS-126, ST-26 and (S)-fluoromethyl 6,9-difluoro-17-[(2-furanylcarbonyl)oxy]-11-hydroxy-16-methyl-3-oxo-androsta-1,4-diene-17-carbothionate (S)-(2-oxo-tetrahydro-furan-3S-yl)6,9-difluoro-11-hydroxy-16-methyl-3-oxo-17-propionyloxy-androsta-1,4-diene-17-carbothionate, cyanomethyl 6α,9α-difluoro-11β-hydroxy-16α-methyl-3-oxo-17α-(2,2,3,3-tertamethylcyclopropylcarbonyl)oxy-androsta-1,4-diene-17β-carboxylate optionally in the form of the racemates, enantiomers or diastereomers thereof and optionally in the form of the salts and derivatives thereof, the solvates and/or hydrates thereof. Any reference to steroids includes a reference to any salts or derivatives, hydrates or solvates thereof which may exist. Examples of possible salts and derivatives of the steroids may be: alkali metal salts, such as for example sodium or potassium salts, sulphobenzoates, phosphates, isonicotinates, acetates, dichloroacetates, propionates, dihydrogen phosphates, palmitates, pivalates or furoates.

PDE4-inhibitors which may be used are preferably compounds selected from among enprofyllin, theophyllin, roflumilast, ariflo (cilomilast), tofimilast, pumafentrin, lirimilast, arofyllin, atizoram, D-4418, Bay-198004, BY343, CP-325.366, D-4396 (Sch-351591), AWD-12-281 (GW-842470), NCS-613, CDP-840, D-4418, PD-168787, T-440, T-2585, V-11294A, CI-1018, CDC-801, CDC-3052, D-22888, YM-58997, Z-15370 and N-(3,5-dichloro-1-oxo-pyridin-4-yl)-4-difluoromethoxy-3-cyclopropylmethoxybenzamide (−)p-[(4aR*,10bS*)-9-ethoxy-1,2,3,4,4a,10b-hexahydro-8-methoxy-2-methylbenzo[s][1,6]naphthyridin-6-yl]-N,N-diisopropylbenzamide (R)-(+)-1-(4-bromobenzyl)-4-[(3-cyclopentyloxy)-4-methoxyphenyl]-2-pyrrolidone 3-(cyclopentyloxy-4-methoxyphenyl)-1-(4-N'-[N-2-cyano-S-methyl-isothioureido]benzyl)-2-pyrrolidone cis[4-cyano-4-(3-cyclopentyloxy-4-methoxyphenyl)cyclohexane-1-carboxylic acid]

2-carbomethoxy-4-cyano-4-(3-cyclopropylmethoxy-4-difluoromethoxy-phenyl)cyclohexan-1-one cis[4-cyano-4-(3-cyclopropylmethoxy-4-difluoromethoxyphenyl)cyclohexan-1-ol]

(R)-(+)-ethyl[4-(3-cyclopentyloxy-4-methoxyphenyl)pyrrolidin-2-ylidene]acetate (S)-(−)-ethyl[4-(3-cyclopentyloxy-4-methoxyphenyl)pyrrolidin-2-ylidene]acetate 9-cyclopentyl-5,6-dihydro-7-ethyl-3-(2-thienyl)-9H-pyrazolo[3,4-c]-1,2,4-triazolo[4,3-a]pyridine 9-cyclopentyl-5,6-dihydro-7-ethyl-3-(tert-butyl)-9H-pyrazolo[3,4-c]-1,2,4-triazolo[4,3-a]pyridine optionally in the form of the racemates, enantiomers or diastereomers thereof and optionally in the form of the pharmacologically acceptable acid addition salts thereof, the solvates and/or hydrates thereof. According to the invention the acid addition salts of the PDE4 inhibitors are preferably selected from among the hydrochloride, hydrobromide, hydriodide, hydrosulphate, hydrophosphate, hydromethanesulphonate, hydronitrate, hydromaleate, hydroacetate, hydrocitrate, hydrofumarate, hydrotartrate, hydroxalate, hydrosuccinate, hydrobenzoate and hydro-p-toluenesulphonate.

The LTD4-antagonists used are preferably compounds selected from among montelukast, pranlukast, zafirlukast, MCC-847 (ZD-3523), MN-001, MEN-91507 (LM-1507), VUF-5078, VUF-K-8707, L-733321 and 1-(((R)-(3-(2-(6,7-difluoro-2-quinolinyl)ethenyl)phenyl)-3-(2-(2-hydroxy-2-propyl)phenyl)thio)methylcyclopropane-acetic acid, 1-(((1(R)-3(3-(2-(2,3-dichlorothieno[3,2-b]pyridin-5-yl)-(E)-ethenyl)phenyl)-3-(2-(1-hydroxy-1-methylethyl)phenyl)propyl)thio)methyl)cyclopropaneacetic acid

[2-[[2-(4-tert-butyl-2-thiazolyl)-5-benzofuranyl]oxymethyl]phenyl]acetic acid optionally in the form of the racemates, enantiomers or diastereomers thereof and optionally in the form of the pharmacologically acceptable acid addition salts, solvates and/or hydrates thereof. According to the invention these acid addition salts are preferably selected from among the hydrochloride, hydrobromide, hydriodide, hydrosulphate, hydrophosphate, hydromethanesulphonate, hydronitrate, hydromaleate, hydroacetate, hydrocitrate, hydrofumarate, hydrotartrate, hydroxalate, hydrosuccinate, hydrobenzoate and hydro-p-toluenesulphonate. By salts or derivatives which the LTD4-antagonists may optionally be capable of forming are meant, for example: alkali metal salts, such as for example sodium or potassium salts, alkaline earth metal salts, sulphobenzoates, phosphates, isonicotinates, acetates, propionates, dihydrogen phosphates, palmitates, pivalates or furoates.

EGFR-inhibitors which may be used are preferably compounds selected from among cetuximab, trastuzumab, ABX-EGF, Mab ICR-62 and 4-[(3-chloro-4-fluorophenyl)amino]-6-{[4-(morpholin-4-yl)-1-oxo-2-buten-1-yl]-amino}-7-cyclopropylmethoxy-quinazoline 4-[(3-chloro-4-fluorophenyl)amino]-6-{[4-(N,N-diethylamino)-1-oxo-2-buten-1-yl]-amino}-7-cyclopropylmethoxy-quinazoline 4-[(3-chloro-4-fluorophenyl)amino]-6-{[4-(N,N-dimethylamino)-1-oxo-2-buten-1-yl]amino}-7-cyclopropylmethoxy-quinazoline 4-[(R)-(1-phenyl-ethyl)amino]-6-{[4-(morpholin-4-yl)-1-oxo-2-buten-1-yl]amino}-7-cyclopentyloxy-quinazoline 4-[(3-chloro-4-fluoro-phenyl)amino]-6-{[4-((R)-6-methyl-2-oxo-morpholin-4-yl)-1-oxo-2-buten-1-yl]amino}-7-cyclopropylmethoxy-quinazoline 4-[(3-chloro-4-fluoro-phenyl)amino]-6-{[4-((R)-6-methyl-2-oxo-morpholin-4-yl)-1-oxo-2-buten-1-yl]amino}-7-[(S)-(tetrahydrofuran-3-yl)oxy]-quinazoline 4-[(3-chloro-4-fluoro-phenyl)amino]-6-{[4-((R)-2-methoxymethyl-6-oxo-morpholin-4-yl)-1-oxo-2-buten-1-yl]amino}-7-cyclopropylmethoxy-quinazoline 4-[(3-chloro-4-fluoro-phenyl)amino]-6-[2-((S)-6-methyl-2-oxo-morpholin-4-yl)-ethoxy]-7-methoxy-quinazoline 4-[(3-chloro-4-fluorophenyl)amino]-6-({4-[N-(2-methoxy-ethyl)-N-methyl-amino]-1-oxo-2-buten-1-yl}amino)-7-cyclopropylmethoxy-quinazoline 4-[(3-chloro-4-fluorophenyl)amino]-6-{[4-(N,N-dimethylamino)-1-oxo-2-buten-1-yl]amino}-7-cyclopentyloxy-quinazoline 4-[(R)-(1-phenyl-ethyl)amino]-6-{[4-(N,N-to-(2-methoxy-ethyl)-amino)-1-oxo-2-buten-1-yl]amino}-7-cyclopropylmethoxy-quinazoline 4-[(R)-(1-phenyl-ethyl)amino]-6-({4-[N-(2-methoxy-ethyl)-N-ethyl-amino]-1-oxo-2-buten-1-yl}amino)-7-cyclopropylmethoxy-quinazoline 4-[(R)-(1-phenyl-ethyl)amino]-6-({4-[N-(2-methoxy-ethyl)-N-methyl-amino]-1-oxo-2-buten-1-yl}amino)-7-cyclopropylmethoxy-quinazoline 4-[(R)-(1-phenyl-ethyl)amino]-6-({4-[N-(tetrahydropyran-4-yl)-N-methyl-amino]-1-oxo-2-buten-1-yl}amino)-7-cyclopropylmethoxy-quinazoline
4-[(3-chloro-4-fluorophenyl)amino]-6-{[4-(N,N-dimethylamino)-1-oxo-2-buten-1-yl]amino}-7-((R)-tetrahydrofuran-3-yloxy)-quinazoline
4-[(3-chloro-4-fluorophenyl)amino]-6-{[4-(N,N-dimethylamino)-1-oxo-2-buten-1-yl]amino}-7-((S)-tetrahydrofuran-3-yloxy)-quinazoline
4-[(3-chloro-4-fluorophenyl)amino]-6-({4-[N-(2-methoxy-ethyl)-N-methyl-amino]-1-oxo-2-buten-1-yl}amino)-7-cyclopentyloxy-quinazoline
4-[(3-chloro-4-fluorophenyl)amino]-6-{[4-(N-cyclopropyl-N-methyl-amino)-1-oxo-2-buten-1-yl]amino}-7-cyclopentyloxy-quinazoline
4-[(3-chloro-4-fluorophenyl)amino]-6-{[4-(N,N-dimethylamino)-1-oxo-2-buten-1-yl]amino}-7-[(R)-(tetrahydrofuran-2-yl)methoxy]-quinazoline
4-[(3-chloro-4-fluorophenyl)amino]-6-{[4-(N,N-dimethylamino)-1-oxo-2-buten-1-yl]amino}-7-[(S)-(tetrahydrofuran-2-yl)methoxy]-quinazoline
4-[(3-ethynyl-phenyl)amino]-6.7-to-(2-methoxy-ethoxy)-quinazoline
4-[(3-chloro-4-fluorophenyl)amino]-7-[3-(morpholin-4-yl)-propyloxy]-6-[(vinyl-carbonyl)amino]-quinazoline
4-[(R)-(1-phenyl-ethyl)amino]-6-(4-hydroxy-phenyl)-7H-pyrrolo[2,3-d]pyrimidine
3-cyano-4-[(3-chloro-4-fluorophenyl)amino]-6-{[4-(N,N-dimethylamino)-1-oxo-2-buten-1-yl]amino}-7-ethoxy-quinoline
4-{([3-chloro-4-(3-fluoro-benzyloxy)-phenyl]amino}-6-(5-{[(2-methanesulphonyl-ethyl)amino]methyl}-furan-2-yl)quinazoline
4-[(R)-(1-phenyl-ethyl)amino]-6-{[4-((R)-6-methyl-2-oxo-morpholin-4-yl)-1-oxo-2-buten-1-yl]amino}-7-methoxy-quinazoline
4-[(3-chloro-4-fluorophenyl)amino]-6-{[4-(morpholin-4-yl)-1-oxo-2-buten-1-yl]-amino}-7-[(tetrahydrofuran-2-yl)methoxy]-quinazoline
4-[(3-chloro-4-fluorophenyl)amino]-6-({4-[N,N-to-(2-methoxy-ethyl)-amino]-1-oxo-2-buten-1-yl}amino)-7-[(tetrahydrofuran-2-yl)methoxy]-quinazoline
4-[(3-ethynyl-phenyl)amino]-6-{[4-(5.5-dimethyl-2-oxo-morpholin-4-yl)-1-oxo-2-buten-1-yl]amino}-quinazoline
4-[(3-chloro-4-fluoro-phenyl)amino]-6-[2-(2,2-dimethyl-6-oxo-morpholin-4-yl)-ethoxy]-7-methoxy-quinazoline
4-[(3-chloro-4-fluoro-phenyl)amino]-6-[2-(2,2-dimethyl-6-oxo-morpholin-4-yl)-ethoxy]-7-[(R)-(tetrahydrofuran-2-yl)methoxy]-quinazoline
4-[(3-chloro-4-fluoro-phenyl)amino]-7-[2-(2,2-dimethyl-6-oxo-morpholin-4-yl)-ethoxy]-6-[(S)-(tetrahydrofuran-2-yl)methoxy]-quinazoline
4-[(3-chloro-4-fluoro-phenyl)amino]-6-{2-[4-(2-oxo-morpholin-4-yl)-piperidin-1-yl]-ethoxy}-7-methoxy-quinazoline
4-[(3-chloro-4-fluoro-phenyl)amino]-6-[1-(tert.-butyloxycarbonyl)-piperidin-4-yloxy]-7-methoxy-quinazoline
4-[(3-chloro-4-fluoro-phenyl)amino]-6-(trans-4-amino-cyclohexan-1-yloxy)-7-methoxy-quinazoline
4-[(3-chloro-4-fluoro-phenyl)amino]-6-(trans-4-methanesulphonylamino-cyclohexan-1-yloxy)-7-methoxy-quinazoline
4-[(3-chloro-4-fluoro-phenyl)amino]-6-(tetrahydropyran-3-yloxy)-7-methoxy-quinazoline
4-[(3-chloro-4-fluoro-phenyl)amino]-6-(1-methyl-piperidin-4-yloxy)-7-methoxy-quinazoline
4-[(3-chloro-4-fluoro-phenyl)amino]-6-{1-[(morpholin-4-yl)carbonyl]-piperidin-4-yl-oxy}-7-methoxy-quinazoline
4-[(3-chloro-4-fluoro-phenyl)amino]-6-{1-[(methoxymethyl)carbonyl]-piperidin-4-yl-oxy}-7-methoxy-quinazoline
4-[(3-chloro-4-fluoro-phenyl)amino]-6-(piperidin-3-yloxy)-7-methoxy-quinazoline
4-[(3-chloro-4-fluoro-phenyl)amino]-6-[1-(2-acetylamino-ethyl)-piperidin-4-yloxy]-7-methoxy-quinazoline
4-[(3-chloro-4-fluoro-phenyl)amino]-6-(tetrahydropyran-4-yloxy)-7-ethoxy-quinazoline
4-[(3-chloro-4-fluoro-phenyl)amino]-6-((S)-tetrahydrofuran-3-yloxy)-7-hydroxy-quinazoline
4-[(3-chloro-4-fluoro-phenyl)amino]-6-(tetrahydropyran-4-yloxy)-7-(2-methoxy-ethoxy)-quinazoline
4-[(3-chloro-4-fluoro-phenyl)amino]-6-{trans-4-[(dimethylamino)sulphonylamino]-cyclohexan-1-yloxy}-7-methoxy-quinazoline
4-[(3-chloro-4-fluoro-phenyl)amino]-6-{trans-4-[(morpholin-4-yl)carbonylamino]-cyclohexan-1-yloxy}-7-methoxy-quinazoline
4-[(3-chloro-4-fluoro-phenyl)amino]-6-{trans-4-[(morpholin-4-yl)sulphonylamino]-cyclohexan-1-yloxy}-7-methoxy-quinazoline
4-[(3-chloro-4-fluoro-phenyl)amino]-6-(tetrahydropyran-4-yloxy)-7-(2-acetylamino-ethoxy)-quinazoline
4-[(3-chloro-4-fluoro-phenyl)amino]-6-(tetrahydropyran-4-yloxy)-7-(2-methanesulphonylamino-ethoxy)-quinazoline
4-[(3-chloro-4-fluoro-phenyl)amino]-6-{1-[(piperidin-1-yl)carbonyl]-piperidin-4-yloxy}-7-methoxy-quinazoline
4-[(3-chloro-4-fluoro-phenyl)amino]-6-(1-aminocarbonylmethyl-piperidin-4-yloxy)-7-methoxy-quinazoline
4-[(3-chloro-4-fluoro-phenyl)amino]-6-(cis-4-{N-[(tetrahydropyran-4-yl)carbonyl]-N-methyl-amino}-cyclohexan-1-yloxy)-7-methoxy-quinazoline
4-[(3-chloro-4-fluoro-phenyl)amino]-6-(cis-4-{N-[(morpholin-4-yl)carbonyl]-N-methyl-amino}-cyclohexan-1-yloxy)-7-methoxy-quinazoline
4-[(3-chloro-4-fluoro-phenyl)amino]-6-(cis-4-{N-[(morpholin-4-yl)sulphonyl]-N-methyl-amino}-cyclohexan-1-yloxy)-7-methoxy-quinazoline
4-[(3-chloro-4-fluoro-phenyl)amino]-6-(trans-4-ethanesulphonylamino-cyclohexan-1-yloxy)-7-methoxy-quinazoline
4-[(3-chloro-4-fluoro-phenyl)amino]-6-(1-methanesulphonyl-piperidin-4-yloxy)-7-ethoxy-quinazoline
4-[(3-chloro-4-fluoro-phenyl)amino]-6-(1-methanesulphonyl-piperidin-4-yloxy)-7-(2-methoxy-ethoxy)-quinazoline
4-[(3-chloro-4-fluoro-phenyl)amino]-6-[1-(2-methoxy-acetyl)-piperidin-4-yloxy]-7-(2-methoxy-ethoxy)-quinazoline
4-[(3-chloro-4-fluoro-phenyl)amino]-6-(cis-4-acetylamino-cyclohexan-1-yloxy)-7-methoxy-quinazoline
4-[(3-ethynyl-phenyl)amino]-6-[1-(tert.-butyloxycarbonyl)-piperidin-4-yloxy]-7-methoxy-quinazoline
4-[(3-ethynyl-phenyl)amino]-6-(tetrahydropyran-4-yloxy]-7-methoxy-quinazoline
4-[(3-chloro-4-fluoro-phenyl)amino]-6-(cis-4-{N-[(piperidin-1-yl)carbonyl]-N-methyl-amino}-cyclohexan-1-yloxy)-7-methoxy-quinazoline 4-[(3-chloro-4-fluoro-phenyl)amino]-6-(cis-4-{N-[(4-methyl-piperazin-1-yl)carbonyl]-N-methyl-amino}-cyclohexan-1-yloxy)-7-methoxy-quinazoline 4-[(3-chloro-4-fluoro-phenyl)amino]-6-{cis-4-[(morpholin-4-yl)carbonylamino]-cyclohexan-1-yloxy}-7-methoxy-quinazoline 4-[(3-chloro-4-fluoro-phenyl)amino]-6-{1-[2-(2-oxopyrrolidin-1-yl)ethyl]-piperidin-4-yloxy}-7-methoxy-quinazoline 4-[(3-chloro-4-fluoro-phenyl)amino]-6-{1-[(morpholin-4-yl)carbonyl]-piperidin-4-yloxy}-7-(2-methoxy-ethoxy)-quinazoline 4-[(3-ethynyl-phenyl)amino]-6-(1-acetyl-piperidin-4-yloxy)-7-methoxy-quinazoline 4-[(3-ethynyl-phenyl)amino]-6-(1-methyl-piperidin-4-yloxy)-7-methoxy-quinazoline 4-[(3-ethynyl-phenyl)amino]-6-(1-methanesulphonyl-piperidin-4-yloxy)-7-methoxy-quinazoline 4-[(3-chloro-4-fluoro-phenyl)amino]-6-(1-methyl-piperidin-4-yloxy)-7(2-methoxy-ethoxy)-quinazoline 4-[(3-chloro-4-fluoro-phenyl)amino]-6-(1-isopropyloxy-carbonyl-piperidin-4-yloxy)-7-methoxy-quinazoline 4-[(3-chloro-4-fluoro-phenyl)amino]-6-(cis-4-methylamino-cyclohexan-1-yloxy)-7-methoxy-quinazoline 4-[(3-chloro-4-fluoro-phenyl)amino]-6-{cis-4-[N-(2-methoxy-acetyl)-N-methyl-amino]-cyclohexan-1-yloxy}-7-methoxy-quinazoline 4-[(3-ethynyl-phenyl)amino]-6-(piperidin-4-yloxy)-7-methoxy-quinazoline 4-[(3-ethynyl-phenyl)amino]-6-[1-(2-methoxy-acetyl)-piperidin-4-yloxy]-7-methoxy-quinazoline 4-[(3-ethynyl-phenyl)amino]-6-{1-[(morpholin-4-yl)carbonyl]-piperidin-4-yloxy}-7-methoxy-quinazoline 4-[(3-chloro-4-fluoro-phenyl)amino]-6-{1-[(cis-2,6-dimethyl-morpholin-4-yl)carbonyl]-piperidin-4-yloxy}-7-methoxy-quinazoline 4-[(3-chloro-4-fluoro-phenyl)amino]-6-{1-[(2-methyl-morpholin-4-yl)carbonyl]-piperidin-4-yloxy}-7-methoxy-quinazoline 4-[(3-chloro-4-fluoro-phenyl)amino]-6-{1-[(S,S)-(2-oxa-5-aza-bicyclo[2,2,1]hept-5-yl)carbonyl]-piperidin-4-yloxy}-7-methoxy-quinazoline 4-[(3-chloro-4-fluoro-phenyl)amino]-6-{1-[(N-methyl-N-2-methoxyethyl-amino)carbonyl]-piperidin-4-yloxy}-7-methoxy-quinazoline 4-[(3-chloro-4-fluoro-phenyl)amino]-6-(1-ethyl-piperidin-4-yloxy)-7-methoxy-quinazoline 4-[(3-chloro-4-fluoro-phenyl)amino]-6-{1-[(2-methoxy-ethyl)carbonyl]-piperidin-4-yloxy}-7-methoxy-quinazoline 4-[(3-chloro-4-fluoro-phenyl)amino]-6-{1-[(3-methoxypropyl-amino)-carbonyl]-piperidin-4-yloxy}-7-methoxy-quinazoline 4-[(3-chloro-4-fluoro-phenyl)amino]-6-[cis-4-(N-methanesulphonyl-N-methyl-amino)-cyclohexan-1-yloxy]-7-methoxy-quinazoline 4-[(3-chloro-4-fluoro-phenyl)amino]-6-[cis-4-(N-acetyl-N-methyl-amino)-cyclohexan-1-yloxy]-7-methoxy-quinazoline 4-[(3-chloro-4-fluoro-phenyl)amino]-6-(trans-4-methylamino-cyclohexan-1-yloxy)-7-methoxy-quinazoline 4-[(3-chloro-4-fluoro-phenyl)amino]-6-[trans-4-(N-methanesulphonyl-N-methyl-amino)-cyclohexan-1-yloxy]-7-methoxy-quinazoline 4-[(3-chloro-4-fluoro-phenyl)amino]-6-(trans-4-dimethylamino-cyclohexan-1-yloxy)-7-methoxy-quinazoline 4-[(3-chloro-4-fluoro-phenyl)amino]-6-(trans-4-{N-[(morpholin-4-yl)carbonyl]-N-methyl-amino}-cyclohexan-1-yloxy)-7-methoxy-quinazoline 4-[(3-chloro-4-fluoro-phenyl)amino]-6-[2-(2,2-dimethyl-6-oxo-morpholin-4-yl)-ethoxy]-7-[(S)-(tetrahydrofuran-2-yl)methoxy]-quinazoline 4-[(3-chloro-4-fluoro-phenyl)amino]-6-(1-methanesulphonyl-piperidin-4-yloxy)-7-methoxy-quinazoline 4-[(3-chloro-4-fluoro-phenyl)amino]-6-(1-cyano-piperidin-4-yloxy)-7-methoxy-quinazoline optionally in the form of the racemates, enantiomers, diastereomers thereof and optionally in the form of the pharmacologically acceptable acid addition salts, solvates or hydrates thereof. According to the invention these acid addition salts are preferably selected from among the hydrochloride, hydrobromide, hydriodide, hydrosulphate, hydrophosphate, hydromethanesulphonate, hydronitrate, hydromaleate, hydroacetate, hydrocitrate, hydrofumarate, hydrotartrate, hydroxalate, hydrosuccinate, hydrobenzoate and hydro-p-toluenesulphonate.

The dopamine agonists used are preferably compounds selected from among bromocriptin, cabergoline, alpha-dihydroergocryptine, lisuride, pergolide, pramipexol, roxindol, ropinirol, talipexol, tergurid and viozan, optionally in the form of the racemates, enantiomers, diastereomers thereof and optionally in the form of the pharmacologically acceptable acid addition salts, solvates or hydrates thereof.

According to the invention these acid addition salts are preferably selected from among the hydrochloride, hydrobromide, hydriodide, hydrosulphate, hydrophosphate, hydromethanesulphonate, hydronitrate, hydromaleate, hydroacetate, hydrocitrate, hydrofumarate, hydrotartrate, hydrooxalate, hydrosuccinate, hydrobenzoate and hydro-p-toluenesulphonate.

H1-Antihistamines which may be used are preferably compounds selected from among epinastine, cetirizine, azelastine, fexofenadine, levocabastine, loratadine, mizolastine, ketotifen, emedastine, dimetindene, clemastine, bamipine, cexchlorpheniramine, pheniramine, doxylamine, chlorophenoxamine, dimenhydrinate, diphenhydramine, promethazine, ebastine, desloratidine and meclozine, optionally in the form of the racemates, enantiomers, diastereomers thereof and optionally in the form of the pharmacologically acceptable acid addition salts, solvates or hydrates thereof. According to the invention these acid addition salts are preferably selected from among the hydrochloride, hydrobromide, hydriodide, hydrosulphate, hydrophosphate, hydromethanesulphonate, hydronitrate, hydromaleate, hydroacetate, hydrocitrate, hydrofumarate, hydrotartrate, hydroxalate, hydrosuccinate, hydrobenzoate and hydro-p-toluenesulphonate.

As pharmaceutically active substances, substance formulations or substance mixtures, any inhalable compounds may be used, also including inhalable macromolecules as disclosed in EP 1 003 478. Preferably, substances, substance formulations or substance mixtures are used to treat respiratory complaints, which are used by inhalation.

In addition, the compound may come from the group of ergot alkaloid derivatives, the triptans, the CGRP-inhibitors, the phosphodiesterase-V inhibitors, optionally in the form of the racemates, enantiomers or diastereomers thereof, optionally in the form of the pharmacologically acceptable acid addition salts, the solvates and/or hydrates thereof.

Examples of ergot alkaloid derivatives are dihydroergotamine and ergotamine.

DESCRIPTION OF THE FIGURES

The Figures shown various embodiments by way of example of capsules for a method according to the invention and the corresponding apparatus, but are intended only as an illustration without restricting the scope of the invention.

FIG. 1 shows a simple embodiment of the capsule 1 used for the process according to the invention, in cross-section. The capsule 1 consists of the cap 2 and the body 3, which are fitted telescopically one inside the other. The cap 2 and body 3 are of the same design and each have a convex base 4.

FIG. 2*a* shows in cross-section an embodiment in which a bead 5 is formed on the body 3 of the capsule 1, tapering towards the closed end of the body. With its side directed towards the open end of the body the bead 5 stands virtually perpendicularly on the body. The edge thus formed delimits the region of the body over which the cap 2 can be pushed telescopically.

Figure 2B:
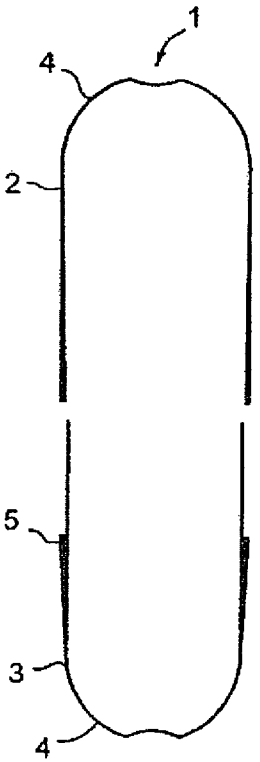
FIGS. 2*a* and 2*b* each show a different embodiment of the capsule with a tapering bead on the body, in lateral cross-section.
Figure 2A:
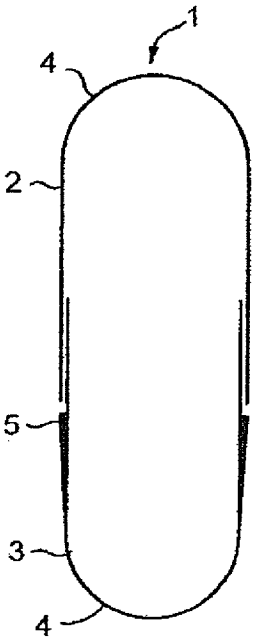
Figure 1:
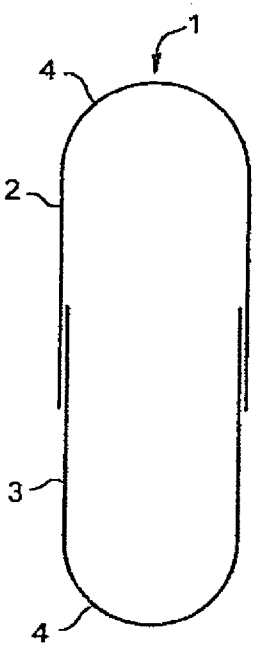
FIG. 1 shows a simple preferred embodiment of the capsule used in the method according to the invention, in lateral cross-section.

Another embodiment is shown in FIG. 2*b*. The cross-section shows that this embodiment differs from the one shown in FIG. 2*a* in that the wall thickness of the cap 2 or of the body 3 is not of the same thickness over the entire area but varies over individual regions. In addition, the convex bases 4 of the cap and body each have a concave indentation at their apex.

Figure 3:
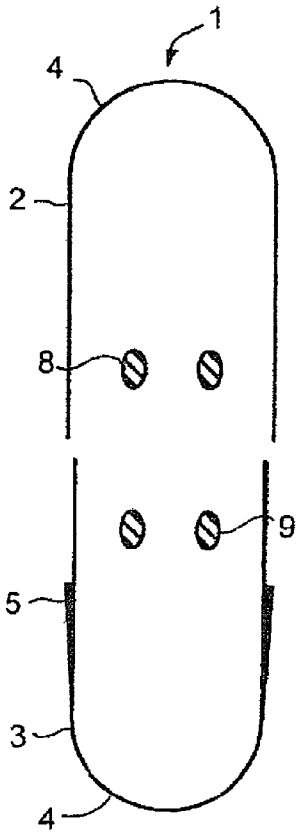
FIG. 3 shows an embodiment of the capsule with a tapering bead on the body and indented or elevated points, respectively, on the body and cap, in front view.

FIG. 3 shows another variant of the invention with indentation points 8 and 9 in front view.

Figure 4:
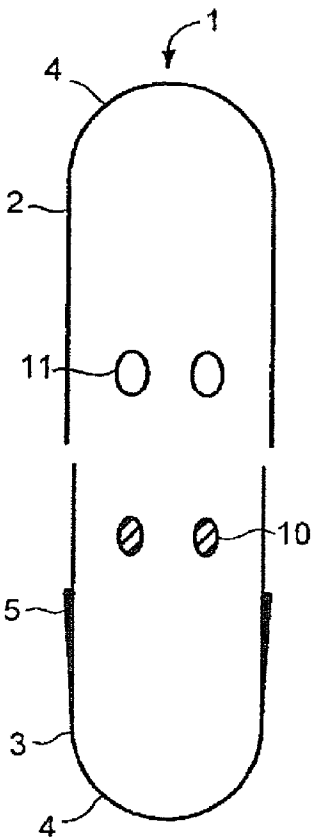
FIG. 4 shows an embodiment of the capsule with a tapering bead on the body and elevated points on the body and holes in the cap, in front view.

FIG. 4 shows a variant of the capsule 1 in which elevations 10 are formed on the body 3 close to the open end and holes 11 are formed in the cap 2 close to the open end, such that the elevations 10 latch in the holes 11 when the capsule is closed.

Figure 5:
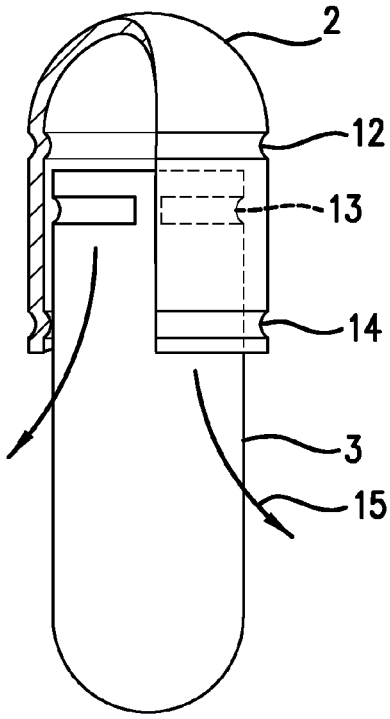
FIG. 5 shows an embodiment of a capsule that allows the exchange of gases in the capsule through breaks in annular indentations.

FIG. 5 shows a capsule with a cap 2 and a body 3, wherein the cap has an upper annular indentation 12 against which the body 3 bears. In addition, a preliminary insertion ring 13 in the form of an encircling indentation is provided on the cap 2, into which the lower annular indentation engages in the pre-inserted state. The encircling rings 12, 13 and 14 are not continuous circles, but have unstamped sections, so as to leave a gas-permeable gap which permits equalisation of the pressure difference and allows a flow of gas 15 after the assembly of the capsule.

Figure 6:
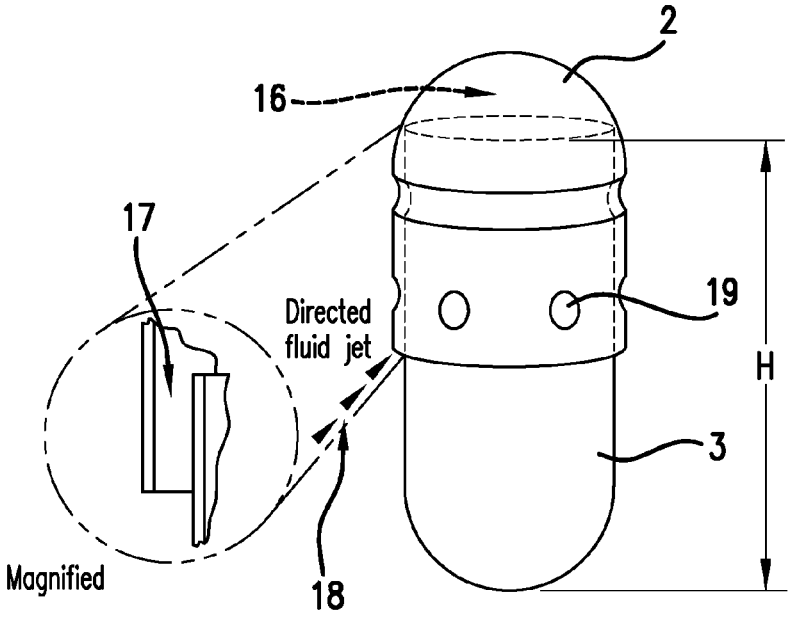
FIG. 6 shows a filled capsule with a defined gap which is suitable for sealing by spraying.

FIG. 6 shows a capsule with a cap 2 and a body 3 after the filling and putting together of the capsule. The body 3 of the capsule has been filled to a fill level H. A volume of residual gas 16 has been enclosed in the cap 2, in particular. An exchange of gases with the environment takes place through a degassing slot 17. In order to achieve a defined spacing of the gap, bulges 19 are provided on the capsule body 3 or dimples 19 on the capsule cap 2. The convexity of the impressed bulges or dimples 19 points towards the respective other capsule part. A sealing fluid in the form of a jet of liquid 18 is sprayed onto the junction region. The sealing solution fills the gap 17 by capillary action; excess sealing solution is removed by suction.

Figure 7:
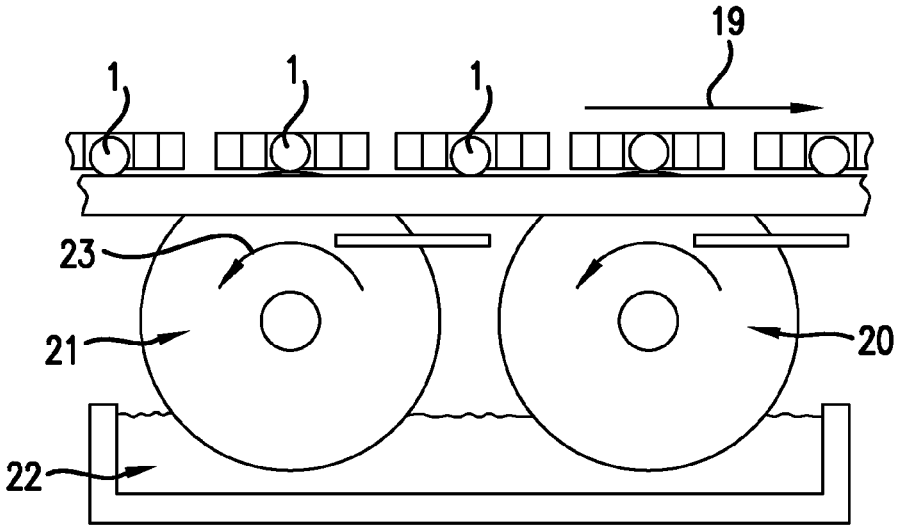
FIG. 7 and FIG. 8 show the application of a band to a filled capsule in a two-step process.
Figure 8:
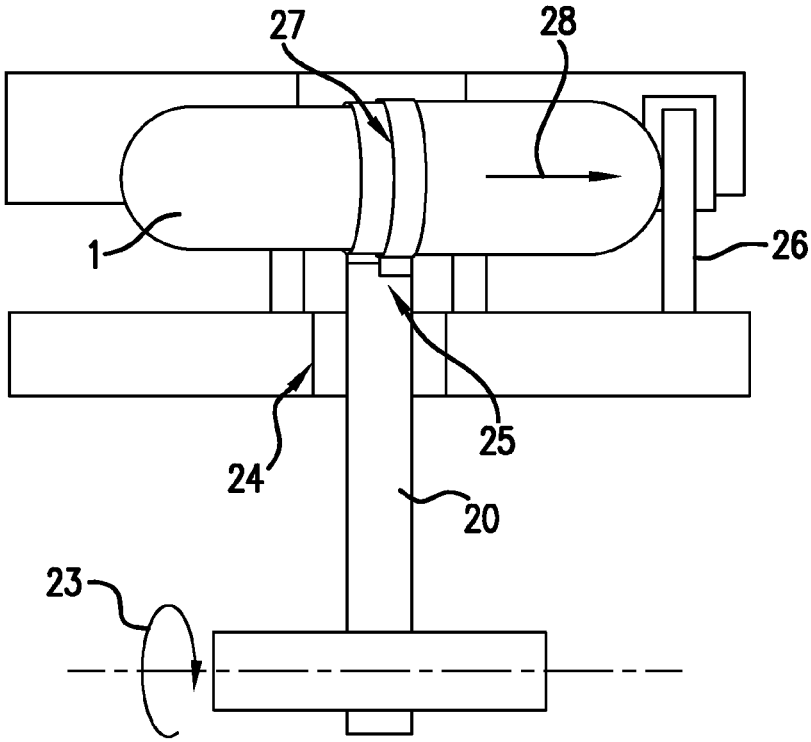

During the banding and sealing of the capsules 1 the latter are conveyed along a travel path 19 by a conveyor belt. Banding discs 20, 21 project into the travel path through recesses 24, as shown in FIGS. 7 and 8. The application of the banding liquid from a bath 22 into which the banding discs are dipped takes place in two stages. A first banding disc 20, which rotates in a direction of rotation 23 counter to the direction of travel of the strip, carries out a first application. The banding disc is profiled 25 on its radial surface in accordance with the geometry of the junction, to achieve a uniform application of the seal.

In order to ensure that the capsule junction is in a defined position, the capsule 1 is subjected to a moment 28 in the direction of an abutment plate 26 against which the cap is pressed by an inherent rotation that is inclined relative to the direction of travel. To achieve greater protection from defects during sealing, a second banding disc 21 carries out another application of banding liquid onto the junction region so as to produce the final shape of the band 27, which is then dried.

Figure 9:
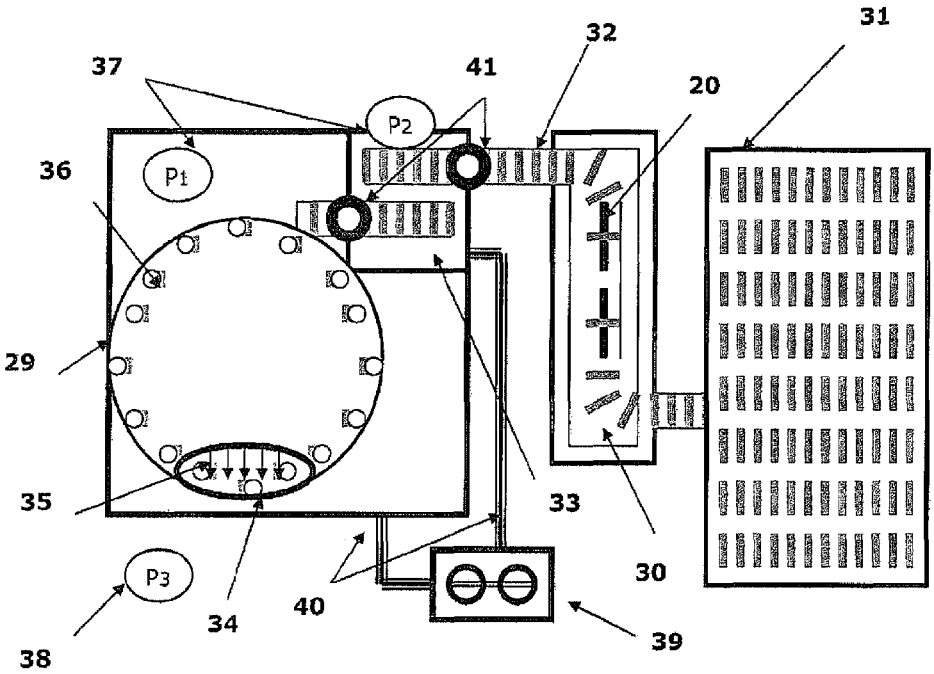
FIG. 9 shows a capsule filling apparatus with means for creating a vacuum and a heated gas current.

FIG. 9 shows an apparatus according to the invention. In a capsule filling machine 29 the capsules are filled with a medicinal active substance. In order to do this, the pre-assembled capsules 1 are gripped and held by capsule carriers 36, the capsule cap 2 is pulled away from the capsule body 3 and the liquid, semisolid or solid active substance is introduced into the capsule body. In the next step the capsule parts are assembled. The assembly takes place in a gas at a pressure P1 which is 300 Pascals below ambient 38. In order to produce this pressure difference, a vacuum pump 39 is provided which is controlled by a process control apparatus such as a computer or SPS.

For detecting the pressure P1 in the sealed-off capsule filling machine, pressure gauges 37 are arranged in the filling machine. They measure the pressure difference with the environment, Delta P=P2−P1, and send these data to the control apparatus. To ensure that uniform pressure prevails in the filling apparatus 29, the capsule filling machine has a gastight airlock 33 into which the capsules are introduced and removed through valve flaps 41. Before capsules are placed in the airlock from the filling machine the vacuum airlock 33 is evacuated through a vacuum line 40 to a pressure P2 which should correspond to the internal pressure of the capsule filling machine. Then the airlock is filled with capsules and closed off from the interior in gastight manner. The airlock chamber is then opened to the outside and adjusts to ambient pressure P3. Alternatively or in addition to the production of a vacuum in the capsule filling machine, there is a nozzle 34 in the region of the fitting together of the capsule parts. This nozzle blows a gas current 35 heated to temperatures of up to 110 degrees Celsius into the capsule cap. The capsule is then cooled to 50 degrees Celsius in the capsule holder 36 by means of a cooling element (Peltier element) integrated in the holder.

The capsules are transported to a sealing machine by transfer means 32. In a banding machine 30 the capsules are sealed by the rolling on of a band.

The seal is dried in a drying cupboard 31. Suitable apparatus and methods for checking the seal and carrying out the packaging follow on from the process.

Figure 10:
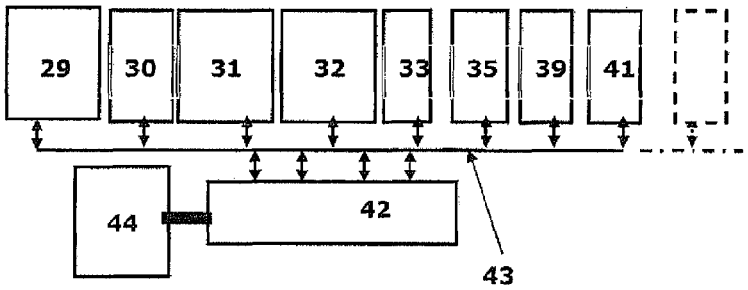
FIG. 10 shows a control device for controlling the equipment and the method.

A control apparatus 42, such as a process directing computer or an SPS, through a bus system, controls the capsule filling machine 29, the banding machine 30, the drying apparatus 31, transfer means 32, a vacuum airlock 33, the temperature and power of a gas current 35, the vacuum pump 39 and vacuum valves 41 as well as other process equipment as shown in FIG. 10. The control apparatus is regulated by software 44 which detects and processes relevant process and measurement data and stores them in a data bank, and also controls the equipment.

EXAMPLES

Typical Operating Data for a Hot Air Blower

Hot air blower 1800 W, electronically regulated. Nozzle with nozzle opening 30 mm×250 mm, hot air temperature adjustable in temperature stages of 2 degrees Celsius between 50 degrees Celsius and 180 degrees Celsius at the nozzle outlet.

Typical Operating Data for Vacuum Pumps

Uno 200 rotary slide pump made by Pfeiffer with a suction of 200 cubic metres per hour or WKP 250 roller piston pump made by Pfeiffer with a suction of 250 cubic metres per hour or MVP 160 diaphragm pump made by Pfeiffer with a suction of 10 cubic metres per hour.

Operating Date for Capsule Filling Machines and Sealing Machines

The operating data are provided by the respective manufacturers. Filling rates of 100000 capsules per hour are achieved.

The banding machine used may be for example the Hicapseal 100 made by Qualicaps, which has a capacity of 80000 to 100000 capsules per hour.

The sealing machine used may be a CFS 1200 made by Capsugel, in which sealing is carried out by spraying the seal onto the gap between the capsule parts.

Examples of Capsules

Length of capsule body: 22.2±0.46 mm; 20.22±0.46 mm; 20.98±0.46 mm; 18.4±0.46 mm; 16.61±0.46 mm; 15.27±0.46 mm; 13.59±0.46 mm; 12.19±0.46 mm; 9.3±0.46 mm.

Length of capsule cap: 12.95±0.46 mm; 11.74±0.46 mm; 11.99±0.46 mm; 10.72±0.46 mm; 9.78±0.46 mm; 8.94±0.46 mm; 8.08±0.46 mm; 7.21±0.46 mm; 6.2±0.46 mm.

Outer diameter of capsule body: 9.55 mm; 8.18 mm; 7.36 mm; 7.34 mm; 6.63 mm; 6.07 mm; 5.57 mm; 5.05 mm; 4.68 mm.

Outer diameter of capsule caps: 9.91 mm; 8.53 mm; 7.66 mm; 7.64 mm; 6.91 mm; 6.35 mm; 5.83 mm; 5.32 mm; 4.91 mm.

Overall length of sealed capsule: 26.1±0.3 mm; 23.3±0.3 mm; 24.2±0.3 mm; 21.7±0.3 mm; 19.4±0.3 mm; 18.0±0.3 mm; 15.9±0.3 mm; 14.3±0.3 mm; 11.1±0.3 mm.

Capsule volumes: 1.37 ml; 1.02 ml; 0.95 ml; 0.91 ml; 0.78 ml; 0.61 ml; 0.59 ml; 0.50 ml; 0.43 ml; 0.37 ml; 0.33 ml; 0.30 ml; 0.26 ml; 0.21 ml; 0.18 ml; 0.13 ml.

Weight of capsules: 163 mg; 118 mg; 110 mg; 96 mg; 76 mg; 61 mg; 48 mg; 38 mg; 28 mg.

The invention claimed is:

1. Method for the fluid-tight sealing of capsules containing medicaments, wherein the capsules consist of at least a capsule body and a capsule cap, as capsule parts, which are placed telescopically one inside the other to provide a contact surface therebetween, such that the capsule has defined gaps of 20 microns to 50 microns along the contact surface and wherein bulges or dimples are stamped into the capsule body or capsule cap, where they contact when sealed, to provide said gaps, characterised by the steps of:

filling the capsule parts with a gas that is at a different temperature or pressure or both than the temperature or pressure or both outside the capsule;

fitting the capsule parts together such that a differential pressure reduction in the capsule through said gaps between the capsule body and capsule cap results; and providing a leak-tight seal in said gaps by applying a sealing solution to the circumference of the capsule, wherein the sealing solution has a viscosity of 150 cP to 250 cP, such that the sealing solution penetrates into the gaps as a result of capillary effect.

2. Method according to claim 1, characterised in that the capsule parts are filled with a gas with a relative reduced pressure of 50 Pa to 5000 Pa.

3. Method according to claim 1, which is conducted within a capsule filling machine and is characterised in that the interior of a capsule filling machine is evacuated using a pump.

4. Method according to claim 3, characterised in that the interior of the capsule filling machine is evacuated using a vacuum rotary slide pump.

5. Method according to claim 1, characterised in that the capsules are transported through an airlock chamber out of a capsule filling machine, the airlock chamber being brought to a reduced pressure the same as that inside the machine as the capsules are transferred into it from the capsule filling machine, then the airlock chamber is sealed off in pressure-tight manner relative to the interior and then brought to ambient pressure for releasing the capsules.

6. Method according to claim 1, characterised in that, in the step of filling of the capsule parts with a gas, the capsule parts are filled with a heated gas.

7. Method according to claim 6, characterised in that the gas has a temperature of 50 degrees Celsius to 180 degrees Celsius.

8. Method according to claim 6, characterised in that the capsules are filled with the medicament and then the heated gas is introduced through a nozzle into the open capsule parts before the capsule parts are fitted together.

9. Method according to claim 6, characterised in that the capsules are cooled to a temperature of 20 degrees Celsius to 60 degrees Celsius before applying the sealing solution.

10. Method according to claim 6, characterised in that the gas has a temperature of 80 degrees Celsius to 120 degrees Celsius.

11. Method according to claim 6, characterised in that the sealing solution is applied on the inside circumference of the capsule.

12. Method according to claim 6, characterised in that the sealing solution is applied with a sealing band on the outside circumference of the capsule.

13. Method according to claim 1, characterised in that the capsule parts consist of gelatin or hydroxypropyl methylcellulose (HPMC).

14. Method according to claim 1, characterised in that the capsule parts have walls with a thickness of 0.05 mm to 0.5 mm.

15. Method according to claim 14, characterised in that the capsule wall has a thickness of 0.1 mm to 0.4 mm, the capsule has a length of 13 to 17 mm and the capsule has a diameter of 5.3 mm to 6.3 mm.

16. Method according to claim 1, characterised in that the capsule has a length of 8 mm to 30 mm and has a diameter of 4 mm to 7 mm.

17. Method according to claim 1, characterised in that a band is applied for providing the sealing solution in two stages by means of banding discs.

18. Method according to claim 1, characterised in that the sealing solution is sprayed into the gap between the capsule cap and capsule body.

19. Method according to claim 1, characterised in that an aqueous gelatin solution or an ethanol-based HPMC solution is applied as the sealing solution.

20. Method according to claim 1, characterised in that the capsule parts are filled with a gas with a relative reduced pressure of 100 Pa to 500 Pa.

* * * * *